United States Patent [19]

Hardison et al.

[11] 4,000,811

[45] Jan. 4, 1977

[54] SHIPPING-DISPLAY CONTAINER

[75] Inventors: Jerry C. Hardison, Dallas; Laverne E. Gray, Irving, both of Tex.

[73] Assignee: Lone Star Container Sales Corporation, Dallas, Tex.

[22] Filed: Mar. 12, 1975

[21] Appl. No.: 557,528

[52] U.S. Cl. ..... 206/44 R; 229/15; 229/51 TS

[51] Int. Cl.[2] ..... B65D 5/54; B65D 5/48

[58] Field of Search ..... 206/44.12, 45.12, 498, 206/44 R; 229/51 TS; 211/126

[56] References Cited

UNITED STATES PATENTS

| | | | |
|---|---|---|---|
| 1,273,894 | 7/1918 | Madison | 211/126 UX |
| 2,614,883 | 10/1952 | Anderson, Jr. et al. | 229/39 R |
| 2,937,742 | 5/1960 | Michiel | 206/44.12 |
| 3,137,437 | 6/1964 | Svensson | 229/51 DB |
| 3,258,188 | 6/1966 | Houston | 229/15 |
| 3,302,853 | 2/1967 | Locke | 229/39 R |
| 3,674,133 | 7/1972 | Locke | 206/44 R |
| 3,737,094 | 6/1973 | Beaver et al. | 206/44 R |
| 3,858,717 | 1/1975 | Peters | 206/44.12 |
| 3,884,348 | 5/1975 | Ross | 206/45.12 |

*Primary Examiner*—Leonard Summer
*Attorney, Agent, or Firm*—Richards, Harris and Medlock

[57] ABSTRACT

A shipping container or carton having weakened portions which allow the container to convert to a display dispenser tray capable of vertical stacking.

25 Claims, 15 Drawing Figures

SHIPPING-DISPLAY CONTAINER

BACKGROUND OF THE INVENTION

The present invention relates to improvements in containers and cartons for use in shipping merchandise and the like, and more particularly to an improved container which can be used for shipping, storage, display and dispensing of merchandise.

In the manufacture, transportation and sale of articles it has been a general practice to employ containers or cartons to transfer goods from the place of manufacture to the place of sale whereupon the goods must be unpacked from the container and placed on shelves for display and sale in the store. Although such devices have served their purpose of transporting the goods from the manufacturer to the seller, they have not proved entirely satisfactory under all conditions of service because substantial labor is required to remove the merchandise from the carton and place it on the shelves in retail stores. Those concerned with the cost of stocking articles of merchandise in retail stores have recognized the need for a dual purpose carton or container which can be utilized to ship the goods from the manufacturer to the retailer and can be easily converted for use by the retailer as a display-dispensing device. This dual purpose carton eliminates the necessity of unpacking the goods from the container and transferring the goods to the shelves of the retail outlet.

To provide this dual purpose, the container must be of a sufficient strength and durability to be used as a shipping container for transporting the goods from the point of manufacture to the wholesaler and ultimately to the retail outlet. In addition, it is highly desirable that the container comply with governmental and shipper strength requirements and regulations. This is necessary for the container to be used to ship the goods through interstate commerce by common carriers. Thus, it is highly desirable that the container be of sufficient strength that it will not come apart during normal shipping activities.

It is also important that the carton or container be designed to minimize damage to the articles therein while converting the shipping container to a display and dispensing container. This is important in those instances where the container is used to ship individual packages formed from sheet material and containing granular material such as flour, sugar, salt and the like. The use of sharp or pointed tools to cut the container in converting the container to a display container is highly undesirable in that the tool may pierce or damage the individual packets in the container during this conversion process thus, spoiling portions of the goods.

In addition, if the conversion process requires substantial amounts of labor, the advantage in eliminating the labor required in unpacking of the shipping container and transferring of the materials to the shelves of the retailer will be offset by the labor required in converting the container to a display and dispensing container. Therefore, it is highly desirable that the container provide for easy conversion with a minimum amount of labor.

There is also an increasing trend in retail outlets, such as grocery stores, to stock merchandise on the shelves where the goods are removed by the customer rather than in a remote storage area. This insures the presence of articles when they are needed and makes it highly desirable that the containers used to ship the goods conform to these requirements. Thus, it is of primary importance that the container be capable of vertical stacking. It is also important that the containers be capable of stacking in either a shipping or display configuration thus, allowing for the conversion of the top two or three layers of the containers to display and dispensing configuration, so that as goods are removed from the top container, the container can be easily discarded and the next layer of containers utilized to display and dispense the goods without periodic attention of store personnel to convert the next lower container at that particular time. This advantage provides ease in access for the consumer of all the goods present on the shelves.

In addition, it is highly desirable that the cost consideration of the manufacturer of the goods be taken into consideration in design of the container. It is important that the container be of such a design that it can be loaded by conventional automatic loading apparatus presently available on the market. In addition, the cost of the container itself is of extreme importance to the manufacturer of the goods shipped therein in his competition with other manufacturers.

Attempts have been made to design containers which satisfy these needs. Typical examples of these attempts can be found in U.S. Pat. Nos.:

2,020,876 to Clark et al;
2,042,107 to Koeble;
2,152,079 to Mott;
3,111,255 to Skowranski;
3,139,979 to Russell;
3,360,182 to Gunn;
3,403,836 to Farquhar;
3,510,046 to Reiner;
3,653,495 to gray.

Although these containers have served their purpose, they have not proven satisfactory under all conditions of service.

SUMMARY OF THE INVENTION

The general purpose of this invention is to provide an improved shipping and display-dispensing container which is inexpensive to manufacture and use, yet is strong and durable for use in shipping a plurality of articles. In addition, the container can be stacked in either the shipping or dispensing configurations and is provided with a removable center divider supporting wall with an improved interlocking arrangement for positioning the wall in place. One embodiment incorporates the use of a container bottom which is quick and simple to assemble. In addition, the improved container can be simply converted from a shipping container to a display tray.

More particularly, the present invention provides a shipping container having front, rear and side walls. The top and bottom walls are formed by flaps extending from the front, rear and side walls. Tear strip means are provided for removing the top and portions of the sides and front of the container whereby the articles in the container can be simply and easily viewed and removed. The tear strip means is positioned so that on completion of the conversion, substantial portions of the side walls are remaining at a level of the height of the box to provide support for vertical stacking of the container. In addition, a removable center divider support wall is provided in the container and further facilitates stacking. The center wall is formed by a folded portion having flanges extending along the back wall of the container and a notch adjacent the front wall. A tab is separated from the front wall top flap to engage the notch and position the center wall when the container is in the shipping condition. An improved bottom can be formed by side wall flaps having a pair of parallel spaced slots adjacent to the edges thereof. Tab portions are formed on the front and rear wall bottom flaps whereby the tabs engage and lock in the slots in the side wall flaps to define a quick-formable bottom.

BRIEF DESCRIPTION OF THE DRAWINGS

The objects and many of the attendent advantages of the invention will be readily appreciated by those of ordinary skill in the art as the same becomes better understood by reference to the following detailed description when considered in connection with the accompanying Drawings illustrating the invention and wherein.

DESCRIPTION OF THE PREFERRED EMBODIMENT

Figure 1:
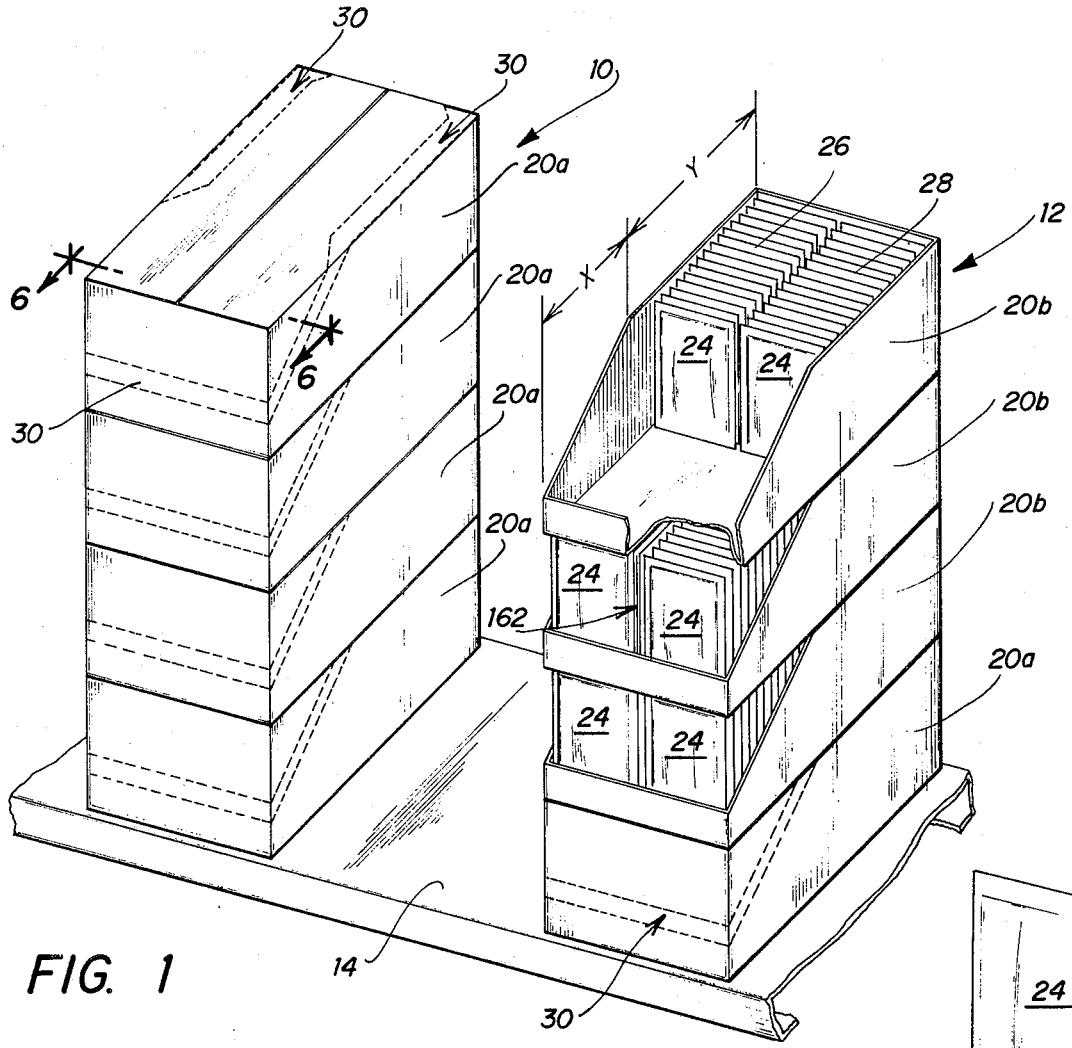
FIG. 1 illustrates a perspective view of a plurality of improved containers of the present invention in both the shipping and display configurations positioned in vertical stacks.

Referring now to the drawings wherein like reference characters designate like or corresponding parts throughout the several views, there is illustrated in FIG. 1 a typical retail shelving configuration as viewed by a consumer with the improved shipping and display-dispensing container of the present invention positioned thereon which, for purposes of description, is identified by reference numeral 20. More particularly, in FIG. 1 two vertical stacks 10 and 12 of the improved container 20 of the present invention are illustrated supported from a horizontal surface such as a typical retail shelf 14. It is envisioned, of course, that the containers could be stacked on the floor or any other horizontal surface.

In the left-hand stack 10 four improved containers are shown stacked vertically one on top of the other. These containers are in a configuration for shipping and storage and are identified by reference numeral 20*a*. When in the shipping and storage configuration, the containers have a rectangular parallelopiped shape. The right-hand stack 12 contains four containers 20 positioned in a vertical stack with the bottom container 20*a* in the shipping configuration and the top three containers of the stack in the display dispensing tray configuration which are identified by reference numeral 20*b*.

Figure 1A:
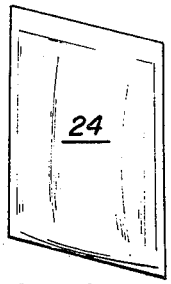
FIG. 1*a* illustrates one example of a package used with the container.

In the embodiment illustrated, the containers 20 are utilized to ship and store a plurality of different types and sizes of articles. In FIG. 1, the articles 24 are illustrated as being packages which are formed from sheet material and contain granular material. An example of these packages can be found in the 2½ ounce packages which are formed from sheet material and contain granular material such as biscuits, pancakes, cornbread, and the like. An illustration of one of these articles 24 is shown in FIG. 1*a*. It is to be understood, of course, that other articles could be shipped, stored and displayed in the containers 20 and the articles 24 have limited top to bottom strength and are described to illustrate particular features and advantages of the present invention with this type of article. As is illustrated, the container or tray 20*b* has articles 24 positioned in two side-by-side rows 26 and 28. In one embodiment, eighteen articles 24 are contained in each row when the container is full.

According to a particular feature of the present invention which is illustrated in FIG. 1, the containers 20, whether in the shipping configuration 20*a* or display-dispensing configuration 20*b*, can be stacked in vertical stacks one on top of the other in any order or configuration desired. The trays 20*b* can be stacked on top of the containers 20*a* or vice versa. Trays 20*b* can be stacked on top of other trays 20*b* to provide dispensing of the articles from a plurality of levels. In this manner, the trays 20*b* in the stack 12 can be used to dispense various products from the same stack. This stacking provides high density storage and allows for dispensing from a plurality of levels of these trays 20*b* in the stack. The stacking versatility in particularly unique when it is considered that the articles 24 are flexible and possess very little top to bottom stacking strength.

According to another feature of the present invention, the maximum width, height and depth dimensions of the container whether in the shipping configuration 20*a* or in the display-dispensing configuration 20*b* are identical. Only portions of the walls of the container are removed in the display-dispensing tray configuration 20*b* to allow viewing and dispensing of the articles from the container.

According to another particular feature of the present invention, the container 20*a* is provided with tear strip means 30 which can be simply and easily removed from the container 20*a* to convert the container to the configuration 20*b* with a minimal amount of labor. In addition, as will be hereinafter specifically pointed out, the particular position of the tear strip means 30 provides a shipping container 20*a* which is durable in use in the shipping and storage of the articles 24.

Figure 2:
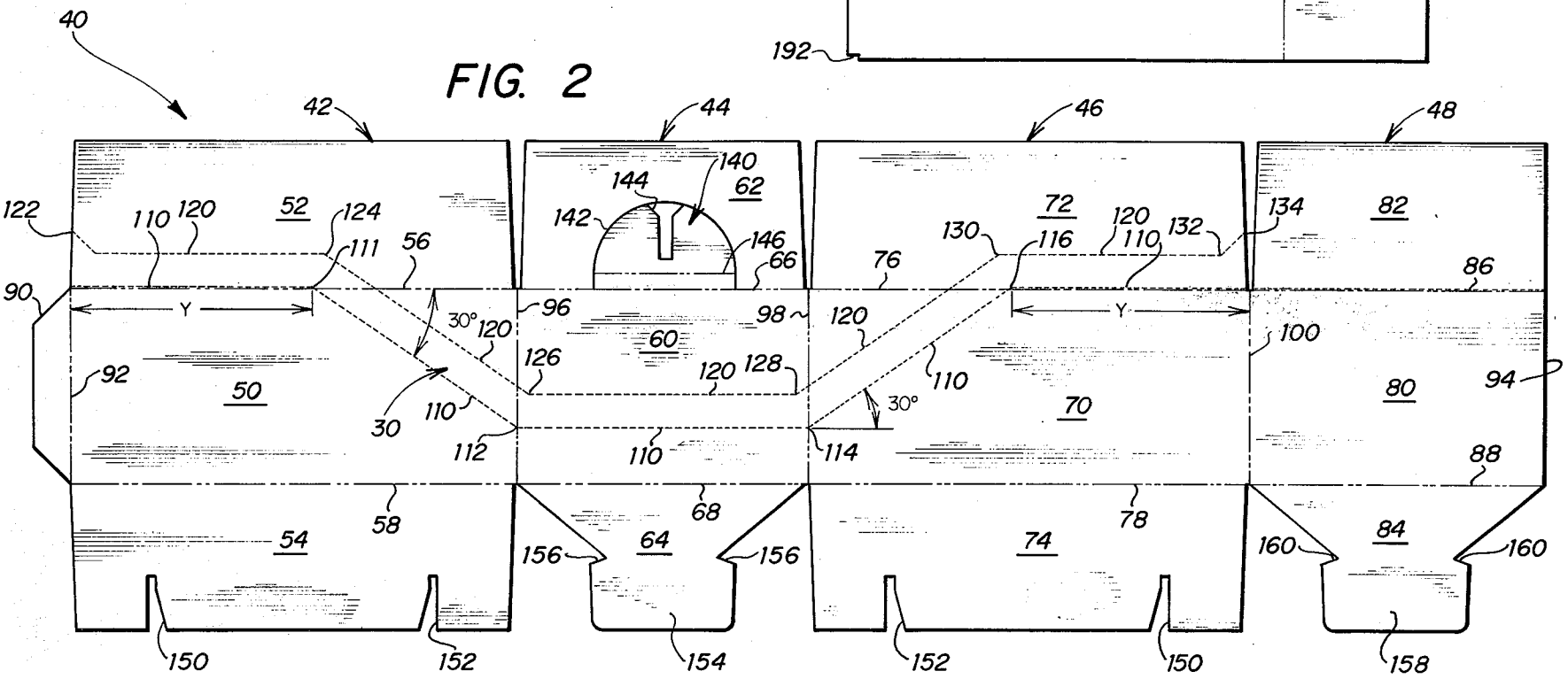
FIG. 2 is an enlarged detail view of a portion of the pattern of the container shown in FIG. 1.

Turning now to the remaining figures, the details of the present embodiment of the container 20 will be described. In FIG. 2, a flat sheet or blank 40 of material is shown cut to a pattern utilized in forming a portion of an embodiment of the container 20 of the present invention. The sheet 40 is formed from a suitable material such as corrugated cardboard and can be cut to the pattern by equipment well known in the art. In addition, printing can be provided on the sheet 40 as desired for the exterior of the container 20. The sheet 40 is divided into four portions, i.e., left side portion 42, front portion 44, right side portion 46, and a rear portion 48.

The left side portion 42 has a rectangular left side wall 50 with top and bottom wall flaps 52 and 54, respectively, separated from the left side wall 50 by edge lines 56 and 58, respectively.

The front portion 42 has a rectangular front wall 60 and top and bottom front wall flaps 62 and 64, respectively, separated therefrom by edge lines 66 and 68, respectively.

The right side portion 46 has a right side wall 70 and top and bottom right side wall flaps 72 and 74, respectively, separated therefrom by edge lines 76 and 78, respectively.

The rear portion 48 has a rectangular rear wall 80 with top and bottom rear wall flaps 82 and 84 separated by edge lines 86 and 88, respectively.

In addition, the left side wall 50 has a trapezoidal tab 90 separated from the wall 50 side edge line 92. The tab 90 is used in assembling the container 20 and is attached to the inside of the rear wall 80 adjacent to the edge 94 with the edge line 92 adjacent to and parallel to the edge 94. The attachment of the tab 90 to the inside of the rear wall 80 can be accomplished by stapling, adhesive or other conventional methods of forming containers as are well known in the art.

For purposes of illustration of the present invention, a code has been adapted to indicate various types of forming operations on the sheet 40. Lines which are shown in phantom lines, such as 92, 58, 68, 78 and 88 represent fold lines which have been formed in the sheet 40. The material of sheet 40 is scored in a conventional manner along these lines to assist in folding. It is envisioned, of course, that other types of operations could be performed on the material to assist in folding along these lines as long as these operations do not materially destroy the strength of the container along these lines.

The dashed lines in FIG. 2, such as those bordering the tear strip means 30 and along edge line 86 depict perforated scores to assist in separating the sheet 40 along these lines. These perforated score lines form weakened tear lines for permitting separation of the sheet 40 therealong. The solid lines in FIG. 2 depict lines along which the sheet 40 has been severed or cut.

The walls 50 and 60 are separated by an edge line 96, whereas the wall 60 is separated from wall 70 by an edge line 98 and the wall 70 is separated from wall 80 by an edge line 100 as is depicted in FIG. 2. The sheet 40 is formed to fold at 90° along each of the lines 92, 96, 98 and 100. This allows the container to be folded and the tab 90 to be attached to the inside of wall 80 to form a right angled cross-section container. In this configuration the walls 50 and 70 will be in a spaced parallel relationship to each other and the walls 60 and 80 in a spaced parallel relationship to each other.

As it is illustrated in FIG. 2, the top and bottom wall flaps are severed from each other so that when the tab 90 is attached to the inside of wall 80, four top and bottom wall flaps will extend from the walls and be free to fold in and form the top and bottom of the container.

According to the particular feature of the present invention, tear strip means 30 is formed in the sheet 40 by two spaced perforated score lines. As can be seen in FIG. 2, the tear strip means if formed partially in the side wall top flaps 52 and 72, partially in the side walls 50 and 70 and partially in the front wall 60. In addition, a perforated score line is formed along the edge line 86 to allow severing the rear wall top flap 82 from the rear wall 80.

According to one embodiment of the present invention, tear strip means 30 is bordered on one side by a perforated score line 110 which extends from the intersection of edge lines 56 and 92 and along the edge 56 a distance "Y" to a point 111. The distance Y, in the preferred embodiment, is greater than one half of the complete length of the edge line 56. Line 110 then turns downward at approximately a 30° angle to intersect the edge 96 at a point 112 spaced above the edge line 86. The score line 110 then extends across the front wall 60 parallel to the edge 68 and intersects the edge 98 at point 114. Line 110 then proceeds upward across the wall 70 at approximately a 30° angle to intersect the edge 76 at a point 116. The final leg of the score line 110 then extends along the edge line 76 a distance Y to intersect and terminate at the intersection of the edge line 76 and edge line 100.

The tear strip means 30 is bound on the opposite side by a second perforated score line 120. Line 120 is spaced from the line 110 and extends across the left side top wall flap, left side wall, front wall, right side wall, and right side wall top flap. Line 120 begins at a point 122 on the edge of the left side top wall flap 52. The score line 120 extends from the point 122 in a downward direction at approximately a 45° angle and then turns to extend parallel to the portion of score line 110 formed along edge line 56. Line 120 extends approximately a distance Y to a point 124 and then turns downward at approximately 30° and extends across the left side wall 50 to intersect the edge 96 at point 126. Line 120 then extends across the front wall 60 parallel to the line 110 to intersect the edge line 98 at point 128. Line 120 then extends upward at approximately a 30° angle across the right side wall 70 and into the right side wall top flap 72 to a point 130. The score line 120 then turns parallel to the edge 76 and extends across the flap 72 to a point 132 where it turns upward at a direction of 45° to intersect the edge of the flap 72 at point 134.

The top wall flaps 52, 62, 72 and 82 are rectangular shaped and are dimensioned in accordance with coventional design techniques in forming a container top wall from four flaps. As will be described in more detail, the top wall of container 20 is conventionally formed by first folding the flaps 62 and 82 in and down and thereafter, folding the flaps 52 and 72 in and down thereover. The portions of flaps 52 and 72 overlapping flaps 62 and 82 can then be attached together in a conventional manner.

According to another feature of the present invention, the front wall top flap 62 can have a divider positioning and locking means 140 formed therein. This divider locking means 140 is formed in the top wall flap 62 by severing the flap 62 along a semicircular line 142 to form a tab. The semicircular line 142 extends from the edge 66 and is centrally positioned in flap 62. In addition, a notch 144 is formed in the means 140 and is centrally positioned therein. A fold line 146 is formed across the means 140 to extend parallel to the edge line 66.

The bottom wall of the container 20 is formed from bottom wall flaps 54, 64, 74 and 74 The bottom wall flaps 54 and 74 are identically shaped. The bottom wall flaps 64 and 84 are also identically shaped. The left side wall bottom flap 54 is generally rectangular in shape and has a pair of spaced slots 150 and 152 therein. In a similar manner, right side wall bottom flap 74 has slots 150 and 152 therein.

The front wall bottom flap 64 has a tub 154 formed on the end thereof and shoulders 156 on either side of the tab 154 for use in locking tab 154 in the slots 152. In a similar manner, the rear wall bottom flap 84 is provided with a tab 158 with shoulders 160 on either side thereof for locking in the slots 150. The particular advantages of the bottom wall construction of the container 20 will be hereinafter described in detail by reference to FIGS. 7, 8, 9 and 10. It is only important, at this point, to note that the flaps will interlock to form a rigid bottom for the container 20.

Figure 3:
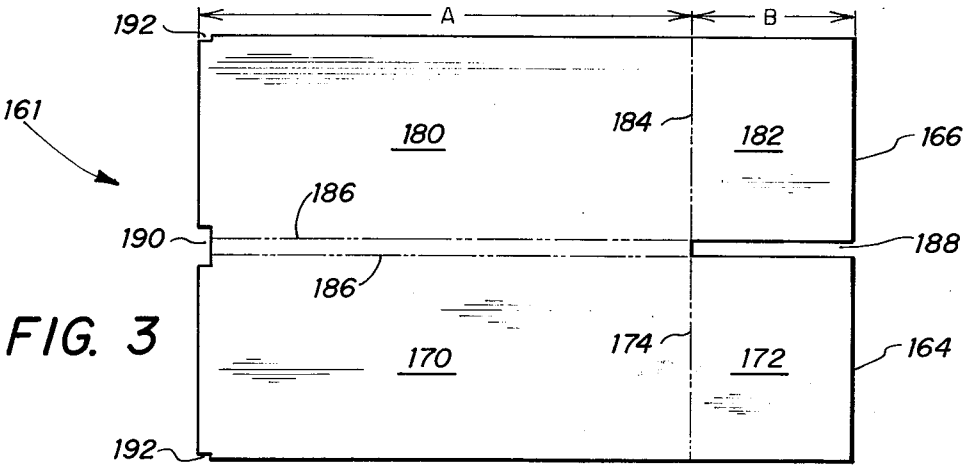
FIG. 3 is an enlarged detail view of the pattern of the central wall insert.

In FIG. 3, a sheet 161 of material is shown cut to a pattern utilized in forming another portion of one embodiment of the container 20 of the present invention. The sheets 40 and 161 can be formed from suitable material such as corrugated cardboard, or the like. The sheet 161 can be processed in the same manner as described with respect to the sheet 40 of FIG. 2.

Sheet 161 is used to form a center divider and support wall 162 for the container 20. Sheet 161 is divided into right and left portions 164 and 166, respectively. The right portion 164 consists of rectangular right facing wall 170 separated from a right flange 172 by fold line 174. The left portion 166 consists of a left facing wall 180 separated from a left flange 182 by a fold line 184. The length A of the left and right walls in equal to the inside length dimension of the container 20, when assembled. The lengths B of the right and left flanges 172 and 182 are equal to one-half of the interior width dimension of the container 20. The right wall 170 is connected to the wall 180 by a pair of parallel spaced fold lines 186. The flanges 172 and 182 are separated by a cut line 188.

According to a particular feature of the present invention, a notch 190 is formed in sheet 161 and extends into both the right and left walls 170 and 180, respectively. Corner notches 192 are formed in the walls 170 and 180. By folding the sheet 161 90° along the fold line 186, the walls 170 and 180 can be positioned in a back-to-back relationship. Next, by folding the flanges 172 and 182 along fold lines 174 and 184, the flaps can be positioned to extend at 90° to the walls 170 and 180, thus assembly of the center divider and support wall 162 is complete.

Figure 4:
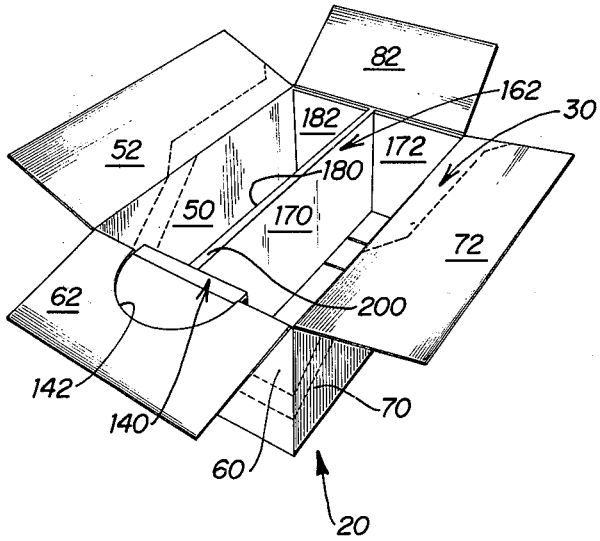
FIGS. 4 and 5 are perspective views of the improved container of the present invention showing the container in the unloaded condition with the central wall inserted therein and the top flaps open.
Figure 5:
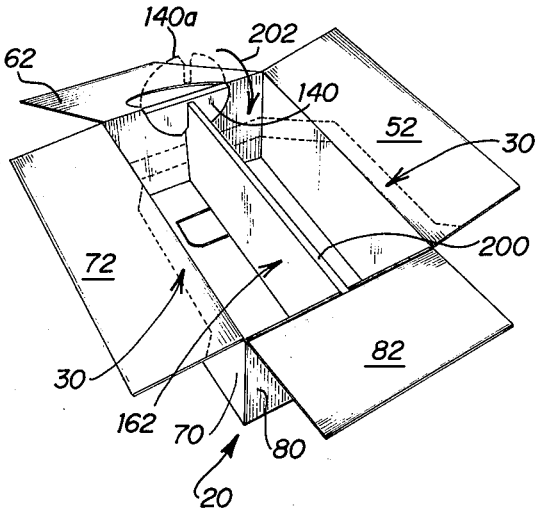
Figure 6:
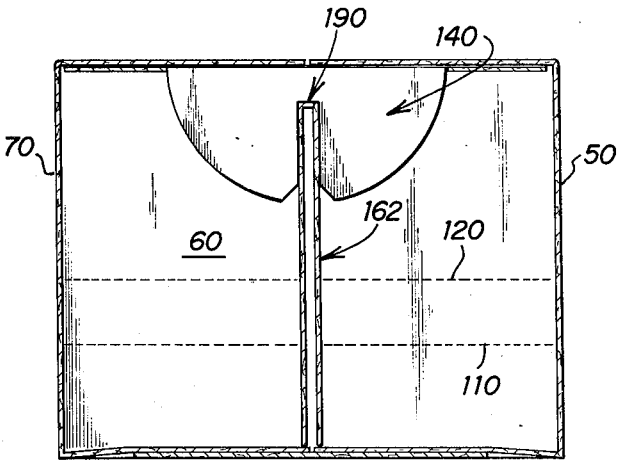
FIG. 6 is a sectional view taken on line 6—6 of FIG. 1, looking in the direction of the arrows.

Once assembled, the wall 162 can then be positioned in the container 20 illustrated with the bottom assemblies in FIGS. 4, 5 and 6. The wall 162 separates the container into two compartments extending along its length. The top of the walls 170 and 180 have a support surface 200 formed between fold lines 186, which extend the length of the container 20 at the height of the walls of the box. The right wall flange 172 is positioned along the rear wall 80 and extends from the right facing wall 170 to the right side wall 70. In a similar manner, the left flange 182 is positioned flush with the rear wall 80 and extends from the left facing wall 180 to the left side wall 50. Thus, the flanges 172 and 182 retain the rear end of the center divider and support wall 162 in a central position within the container 20.

According to a particular feature of the present invention, the divider locking means 140 is provided for retaining the front end of the center divider and support wall 162 in position. This is illustrated in FIGS. 4, 5 and 6, and is accomplished by folding the means 140 from the position shown in dotted lines and identified as 140a in the direction of arrow 202 to the position shown in solid lines in FIG. 5. The locking means 140 is rotated until the wall 162 is locked in the notch 144. In addition, the notch 190 is provided to allow the means 140 to fold down flush with the upper edge of the front wall and to retain the lock 140 in position.

By reference to FIGS. 7, 8, 9 and 10, the assembly of the bottom structure from flaps 54, 64, 74 and 84, will be described. It is understood, of course, that the bottom of the container illustrated in FIGS. 4, 5 and 6, have been previously assembled prior to insertion of the center divider in support wall 162.

Figure 7:
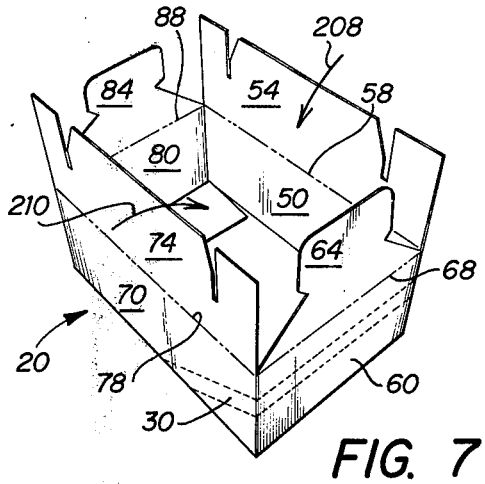
FIGS. 7, 8, 9 and 10 are perspective views illustrating the successive steps of forming the bottom of the improved container of the present invention from the side and rear wall flaps.
Figure 8:
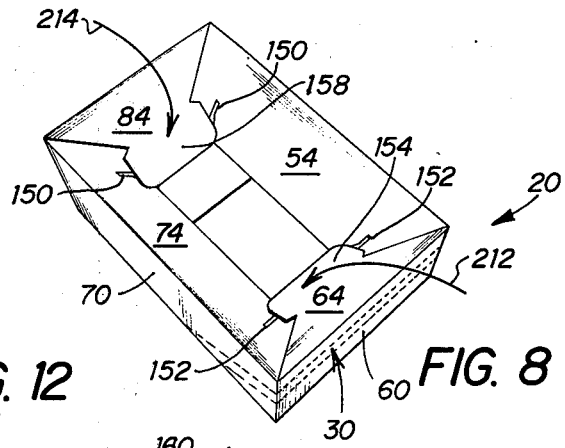
Figure 9:
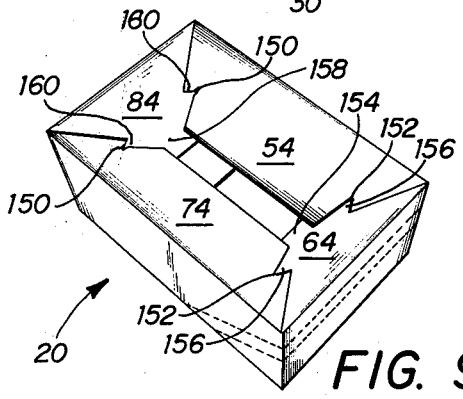
Figure 10:
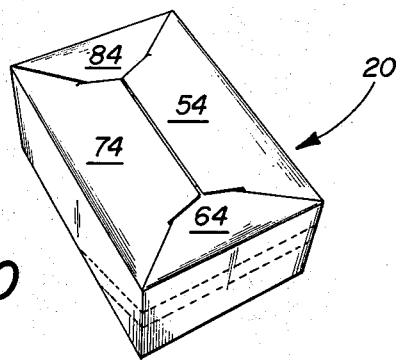

FIG. 7 illustrates the initial position of assembling the bottom of the container 20 with the flaps 54, 64, 74 and 84 extending in a plane with the respective walls 50, 60, 70 and 80. The flaps 54 and 74 are first folded inwardly toward the interior of the box as illustrated by arrows 208 and 210, respectively. These flaps 54 and 74 will bend along lines 58 and 78, respectively. Next, as shown in FIG. 8, the flaps 64 and 84 are folded inwardly on top of the flaps 54 and 74 in the direction of arrows 212 and 214, respectively. The flaps 64 and 84 will bend along lines 68 and 88, respectively. Movement of the flaps 64 and 84 will depress the flaps 64 and 74, as shown in FIG. 8, and this movement is continued until the tab 154 of the flap 64 slides into the slots 152 in flaps 54 and 74. In a similar manner, the tab 158 on flap 84 will slide into the slots 150 on flaps 54 and 74. Next, pressure is released from the flap 64 and 84 and the resiliency of the material will tend to cause the flaps to move in the reverse direction of arrows 208, 210, 212 and 214. This reverse movement will continue until shoulders 160 on tab 158 and the shoulders 156 on tab 154 engage the underside of the flaps 64 and 74 and prevent further movement. Whereupon the bottom of the container will be in the position illustrated in FIG. 10.

As has been previously pointed out, once the bottom of the container is formed, the center divider support wall 162 can be installed in a container with the locking means 140 engaging the front portion of the wall 162. The container would then be in the condition illustrated in FIGS. 4 and 5. As is obvious from studying these Figures, a plurality of articles 24 can be inserted into the container either by hand or by automatic loading equipment to pack the container in a conventional manner.

Thereafter, to close the container, flaps 62 and 82 are folded in to contact and abut the support surface 200 on wall 162 and thereafter, the flaps 52 and 72 were folded in and attached to the upper surfaces of the flaps 52 and 82. This closure of the container is conventional and can be accomplished by common case sealing apparatus currently on the market. The attachment of the various flanges together can be accomplished by stapling or use of suitable adhesives therefore.

It is of particular importance to note that the upper surface of the locking means 140 is positioned flush with the support surface 200 and with the upper edge of the front wall 60. Thus, the flaps 52 and 72 will fold over in a conventional manner and can even be adhesively attached to the upper surface of the locking means 140.

Once the container 20 is closed and filled with articles 24 as described, it will be in the shipping and storage configuration 20*a*, illustrated in FIG. 1. In this configuration, the container provides a conventional shaped container which can be used to transport and store the articles 24 as required. The wall 162 adds to the rigidity and strength of the container to reduce damage to the articles 24 therein when excessive stacking loads are present. Once the container 20*a* is moved to the point of sale of the articles 24, such as at a retailer, the container can be converted to the display-dispensing tray configuration 20*b*, also illustrated in FIG. 1.

Figure 11:
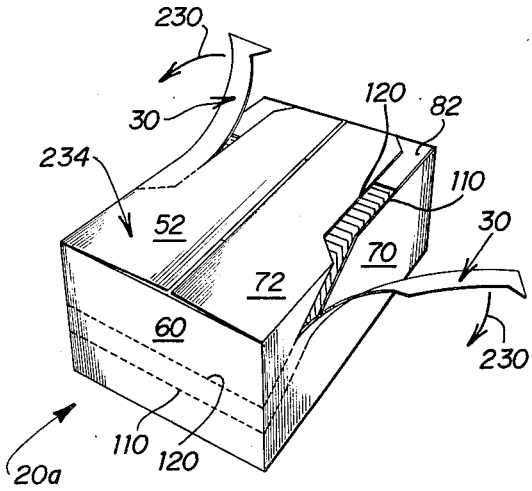
FIG. 11 is a perspective view of the improved container of the present invention in the shipping configuration illustrating the tear tabs being pulled from the container to convert it to the display-dispensing configuration.
Figure 12:
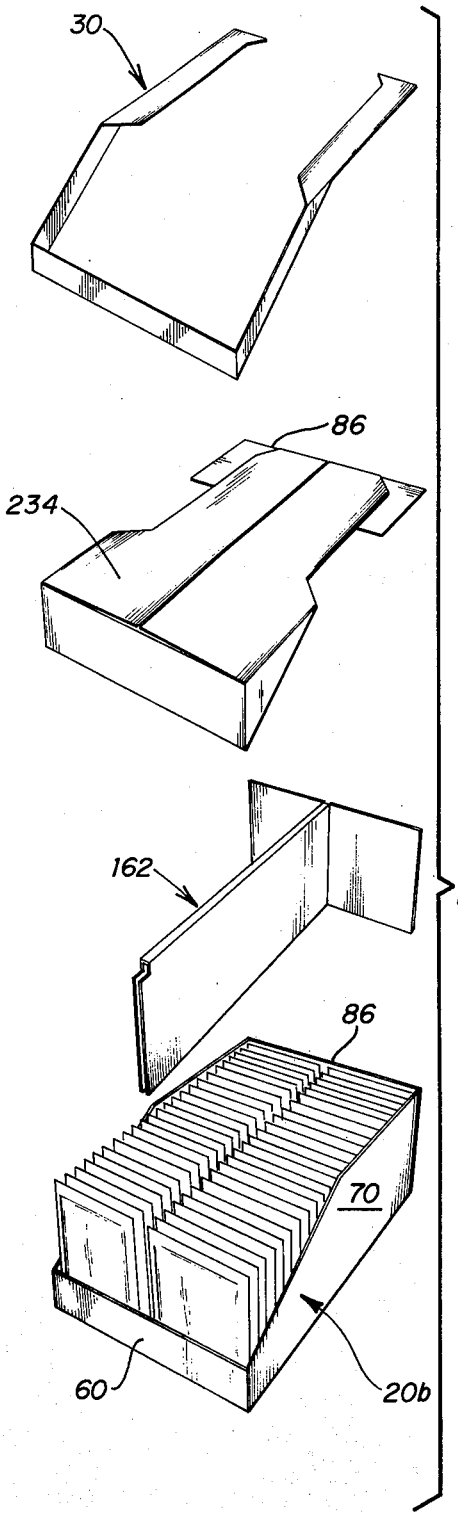
FIG. 12 is an exploded perspective view of the improved container of FIG. 11 showing complete conversion to the display-dispensing configuration with the various parts removed therefrom.

By reference to FIGS. 11 and 12, the process of converting the container from the shipping configuration 20*a* to the display-dispensing tray configuration 20*b* will be described. The first step in the process is to grasp the tear strip means 30 adjacent to the rear wall 80 and pull the tear strip in the direction of arrows 230 (as shown in FIG. 11) until the strip is completely removed from the container 20*a* and is completely torn along score lines 110 and 120. This action will separate a portion of the front wall 60, a portion of the side walls 70 and 50, and the top wall from the front and side walls of the container. Thereafter, the severed portion generally identified in FIG. 12 by reference numeral 234 can be grasped and completely removed by flowing along perforated line 86 to sever the top flap 82 from the rear wall 80.

As is illustrated in FIG. 1, in some cases, it is desirable to leave the center divider wall 162 in place when containers in the display and dispensing configuration 20*b* are stacked in a vertical stack. This wall 162, through support surface 200, provides additional support and stabilizing of the stack of containers in configuration 20*b*. Although the wall 162 provides particular advantages in the present invention, the stacking of the containers 20*b* can also be accomplished without its presence. In fact, containers could be assembled without its presence. In fact, containers could be assembled without the use of the central dividing wall 162 at all. The top container is illustrated in FIG. 1 with the wall 162 removed. In this configuration, support of containers 20*b* positioned above is provided by the remaining portions of the side walls 50 and 70 along edge lines 56 and 76 on the rear wall 80 along edge line 86. The particular importance of extending the remaining portion of the edges 56 and 76 the distance Y in excess of one-half the overall length of the container can be appreciated when it is considered that this edge forms a supporting structure for containers positioned thereabove. Thus, when over one-half to the length of the side wall edges are left after the container is converted to the display-dispensing configuration 20*b*, a stable vertical stack of these containers can be made even when the wall 162 is not present.

Figure 13:
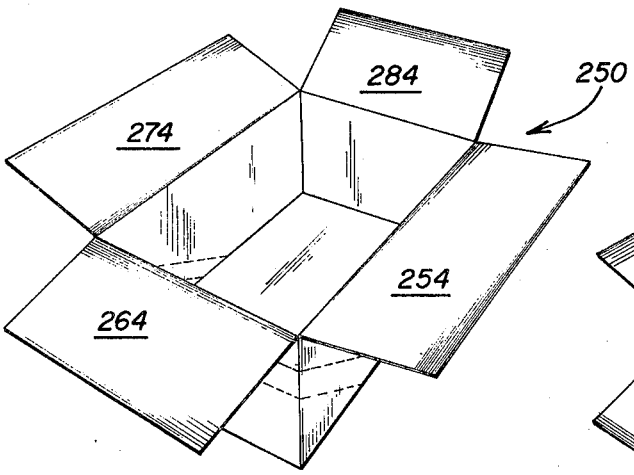
FIG. 13 illustrates an alternate configuration of the bottom of the improved container of the present invention.

In FIG. 13, an alternate embodiment of the container is illustrated. In this embodiment, the container 250 is formed as disclosed in FIG. 2, except that the left side wall bottom flap 254, front wall bottom flap 264, right side wall bottom flap 274 and rear wall bottom flap 284 are constructed in a manner conventional for container design. In this embodiment, the bottom is formed by first folding in the front and rear wall flaps 264 and 284, respectively, and then the side wall flaps 254 and 274 are folded over and connected to the flaps 264 and 284 in the overlapping areas of the flaps. Thus, a conventional container bottom can also be utilized if the advantages of the improved bottom structure of the present invention are not required.

Figure 14:
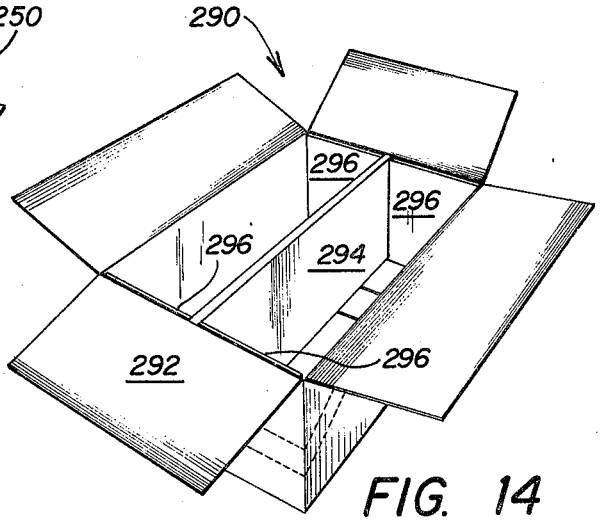
FIG. 14 illustrates an alternate embodiment of the present invention.

A second alternate configuration for the container is illustrated in FIG. 14. In this configuration, the container 290 has a front wall top flap 292 which does not have the divider lock means 140 formed therein. The front and rear ends of the center divider support wall 294 is supplied with flanges 296 identical in construction to the flanges 272 and 282 of the first embodiment of wall 262. These flaps keep the wall 294 in position.

It is also envisioned that the sheet 40 could be formed without the perforated score line 120 therein. In this embodiment, the container could be converted to the dispensing display tray by tearing along the edge line 86 and perforated score line 110. This would eliminate the tear strip and would allow the container to be converted to a dispensing display tray in one step.

It is also anticipated that the shape of the portion removed from the side walls could be different from the triangular shape shown.

The present application discloses a shipping and display-dispensing container which is strong and durable in use and can function under normal shipping conditions without failure. In addition, the container is of a sufficient stability and strength to allow vertical stacking as would normally be present in transportation and storage thereof. Means are provided in the container for easily converting it to a stackable display-dispensing container which allows multi-tier dispensing of articles from the containers. A center divider and support wall is removably provided in the container and means are provided by locking the wall into position to insure retaining the articles in place in the container during shipping, storage and during dispensing, if desired. An improved bottom structure is disclosed which allows for simple assembly of the bottom of the container.

As it will be understood, of course, by those of ordinary skill in the art, numerous modifications and alterations of the present invention can be made without departing from the spirit and scope of the invention as set forth in the appended claims.

What is desired to be claimed is:

1. A container for use in shipping and display of plurality of articles, said container comprising front and rear walls connected together by side walls, top and bottom walls extending from said walls, said top, bottom, front, rear and side walls defining a parallelopiped enclosure for said articles, said top and bottom walls being formed respectively by top and bottom flaps extending from each of said front, rear and side walls; conversion means formed in said shipping container for tearing said shipping container and removing a portion of said container to convert said container to a display tray capable of vertical stacking, said conversion means comprising perforated score lines in said shipping container extending along the edge between said rear and top walls along a portion of each of the edges between said side walls and the top wall, across the front portion of the side walls, and across the front wall along a line spaced from a parallel to the bottom wall to remove a portion of said shipping container whereby said container is converted into a display tray having front rear, bottom and side walls and wherein said articles are visual and can be removed when said tray is positioned with said bottom wall facing downward and said rear wall facing away from said viewing position; divider wall in said container separating said container into two enclosures; a tab extending from the front wall top flap and interlocking with the divider wall whereby movement of the front end of the divider wall is restricted, flaps extending from the rear end of the divider wall and engaging the side walls to hold the rear end of the divider wall in position, the upper edge of said center wall lying in a plane with the edges between said side walls and said top wall; and said front and rear wall bottom flaps each defining tabs and said side wall bottom flaps each having slots therein which cooperate to engage said tabs to form a bottom.

2. A device for use in shipping, display and dispensing of a plurality of articles, said device comprising:

top, bottom, front, rear and two side walls of sheet material forming a rectangular parallelopiped shipping container for shipping said articles, flaps extending from said front, rear and side walls forming said top and bottom walls;

weakened tear lines in said sheet for separating said container along the edge between said rear wall and top wall, along at least a portion of each of the edges between said side walls and said top wall and across said front wall along a line spaced from the edge between said front wall and said bottom wall whereby a portion of said shipping container may be removed to convert said container into a display tray having front, rear, bottom and side walls and wherein said articles are visual and can be removed when said tray is positioned with said bottom wall facing downward and said rear wall facing away from the viewing position;

a removable divider wall extending the length of said container between the front and rear walls dividing the container into two small enclosures; and positioning means for retaining the ends of said divider wall in position in said container, said positioning means comprises a tab extending from said front wall top flap for interlocking with said divider wall.

3. A device as claimed in claim 2 wherein said weakened tear lines extend along at least one-half of the length of the edge between said side walls and said top wall.

4. The device of claim 2 wherein said removed portion comprises the top wall, a portion of each of said side walls, and a portion of said front wall.

5. The container of claim 2 wherein the divider wall extends between the top and bottom walls of said container.

6. The device of claim 2 wherein said positioning means further comprises diverging flanges extending from said divider wall and lying flush against the inside of said rear wall to contact said side walls.

7. The device of claim 2 wherein said front and rear wall bottom flaps each define tabs and wherein said side wall bottom flaps each have slots therein which cooperate to engage said tabs to form a bottom.

8. The device of claim 2 wherein said weakened tear lines are perforated score lines.

9. The device of claim 2 wherein said weakened tear lines extending along the edges between said side walls and said top wall define a support plane extending in spaced parallel relationship to said bottom wall whereby vertical stacking of said container is facilitated.

10. The device of claim 9 wherein the upper edge of said divider wall is positioned in said support plane.

11. A device for use in shipping, display and dispensing of a plurality of articles, said device comprising:

front, rear and two side walls of sheet material, flaps extending from said front, rear and side walls forming top and bottom walls, said top, bottom, front, rear, and side walls forming a shipping container for shipping said articles; and tear strip means formed in said container for removing the top wall, and a portion of the front and of each of the side walls, whereby a portion of said shipping container may be removed to convert said container into a display tray having front, rear, bottom and side walls and wherein said articles are visual and can be removed when said tray is positioned with said bottom wall facing downward and said rear wall facing away from the viewing position, said tear strip means formed by spaced weakened tear lines formed in each of said side wall top flaps, each of said side walls and said front wall, one of said tear lines in each of said side walls top flaps extending along at least a portion of the line between said side wall and said side wall top flap, the other of said tear lines in each side wall top flaps being spaced from said one tear line in said side wall top flap, said two spaced tear lines in each of said side walls extending from the line separating said side wall and said side wall top flap to the line separating said side wall and said front wall, each of said tear lines in said side walls intersecting one of said tear lines in said side wall top flap, and said two spaced tear lines in said front wall extending between the lines separating said side walls and said front wall, each of said tear lines in said front wall intersecting one of said tear lines in each of said side walls.

12. The device of claim 11 wherein said one of said tear lines in each of said side wall top flaps extends at least one-half of the distance between said front and rear walls.

13. The device of claim 11 wherein said tear lines bordering said tear strip extend parallel to each other.

14. The device of claim 11 wherein said tear lines in said side walls are straight lines.

15. The device of claim 11 wherein said tear lines in said front wall extend parallel to the edge between said front and bottom walls.

16. The device of claim 11 additionally comprising a perforated tear line along the border of said rear wall and said rear wall top flap.

17. The device of claim 11 wherein said tear lines extending along the line between said side wall and said side wall top flap defines a support plane extending in a spaced parallel relationship to said bottom wall whereby vertical stacking of said container is facilitated.

18. The device of claim 17 additionally comprising a divider wall in said container.

19. The device of claim 18 wherein the upper edge of said divider wall is positioned in said support plane.

20. A blank for use in forming a shipping and display container comprising:

a unitary piece of sheet material having score lines dividing the piece into front, rear, two side walls, and top and bottom wall flaps extending from said side walls and said front and rear walls whereby top and bottom walls may be formed by said flaps when said piece is assembled into a container; and a tear strip means formed in said piece for use in tearing said piece when assembled into a container, said tear strip means bordered by two spaced perforated tear lines formed in each of said side wall top flaps, each of said side walls, and said front wall, one of said tear lines in each of said side wall top flaps extending along at least a portion of the score line between said side wall and said side wall top flap, the other of said tear lines in each of said side wall top flaps being spaced from said one tear line in said side wall top flap, said two spaced tear lines in each of said side walls extending from the score line separating said side wall and said side wall top flap to the score line separating said side wall and said front wall, each of said tear lines in said side walls intersecting one of said tear lines in said side wall top flap, and said two spaced tear lines in said front wall extending between the score lines separating said side walls and said front wall, each of said tear lines in said front wall intersecting one of said tear lines in each of said side walls.

21. The blank of claim 20 wherein said one of said tear lines in each of said side wall top flap extends at least one-half of the distance between said front and rear walls.

22. The blank of claim 20 wherein said tear lines bordering said tear strip extends parallel to each other.

23. The blank of claim 20 wherein said tear lines in said side walls are straight lines.

24. The blank of claim 20 wherein said tear lines in said front wall extend parallel to the edge between said front wall and said front wall bottom flap.

25. The blank of claim 20 additionally comprising a perforated tear line along the border of said rear wall and said rear wall top flap.

* * * * *

UNITED STATES PATENT OFFICE

CERTIFICATE OF CORRECTION

Patent No. 4,000,811 Dated January 4, 1977

Inventor(s) Jerry C. Hardison and Laverne E. Gray

It is certified that error appears in the above-identified patent and that said Letters Patent are hereby corrected as shown below:

Col. 2, line 30, "Skowranski" should be --Skowronski--;
line 35, "gray" should be --Gray--.

Col. 3, line 12, "attendent" should be --attendant--.

Col. 4, line 45, "versatility in" should be --versatility is--.

Col. 7, line 11, "tub" should be --tab--;
line 36, "in" should be --is--;
line 49, "line" should be --lines--;
line 53, "thus assembly" should be --thus the assembly--.

Col. 10, line 48, "plurality" should be --a plurality--;
line 67, "front rear" should be --front, rear--.

Col. 11, line 3, "divider" should be --a divider--.

Col. 12, line 22, "walls" should be --wall--.

Signed and Sealed this twenty-sixth Day of July 1977

[SEAL]

Attest:

RUTH C. MASON
Attesting Officer

C. MARSHALL DANN
Commissioner of Patents and Trademarks